United States Patent [19]

Biber

[11] Patent Number: 4,822,049

[45] Date of Patent: Apr. 18, 1989

[54] PUZZLE-TYPE AMUSEMENT DEVICE

[76] Inventor: Tuvia Biber, Dror Street 58, Rishon Lezion, Israel

[21] Appl. No.: 167,820

[22] Filed: Mar. 14, 1988

[30] Foreign Application Priority Data

May 25, 1987 [IL] Israel ..... 82650

[51] Int. Cl.[4] ..... A63B 67/14; A63F 9/08

[52] U.S. Cl. ..... 273/110; 273/155; 273/113

[58] Field of Search ..... 273/109, 110, 113, 155, 273/153 S

[56] References Cited

U.S. PATENT DOCUMENTS

| | | | |
|---|---|---|---|
| 558,066 | 4/1896 | Happersett | 273/113 |
| 3,028,704 | 4/1962 | Rambaugh | 273/118 R |
| 3,758,981 | 9/1973 | Hlasnicek | 273/109 |
| 4,376,537 | 3/1983 | Yokoi | 273/153 S |
| 4,487,417 | 12/1984 | Engel | 273/153 S |
| 4,657,255 | 4/1987 | Seres | 273/113 |
| 4,685,679 | 8/1987 | Ben-Gal et al. | 273/155 |
| 4,754,972 | 7/1988 | Boskovic | 273/113 |

FOREIGN PATENT DOCUMENTS

| | | | |
|---|---|---|---|
| 1199351 | 1/1986 | Canada | 273/153 S |
| 8203563 | 10/1982 | PCT Int'l Appl. | 273/155 |
| 2177012 | 1/1987 | United Kingdom | 273/153 S |

*Primary Examiner*—Richard C. Pinkham
*Assistant Examiner*—Gary Jackson
*Attorney, Agent, or Firm*—Benjamin J. Barish

[57] ABSTRACT

A puzzle-type amusement device comprises a stack of rotatable discs formed with two openings adapted to be aligned with each other; and a ball receivable through one of the openings in the top disc so as to pass through the openings aligned therewith in the intermediate discs to rest against the bottom disc. One opening in each intermediate disc is bounded at one side by a tapered surface curved about the axis of rotation of the disc so as to constitute an inclined tract permitting the ball, when received in such opening, to be rolled along the inclined track out of the respective opening in the direction towards the top disc. The other opening in each intermediate disc is bounded on all its sides by an untapered surface such that the opening constitutes a trap preventing the ball, when received in such opening, from being rolled out of the opening in the direction towards the top disc.

20 Claims, 2 Drawing Sheets

FIG 1
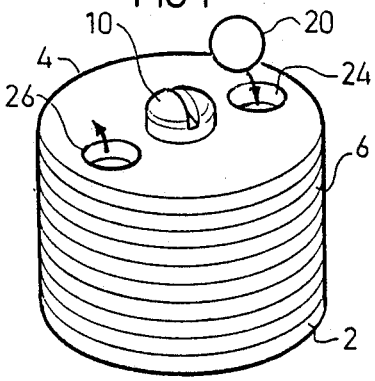
FIG 2
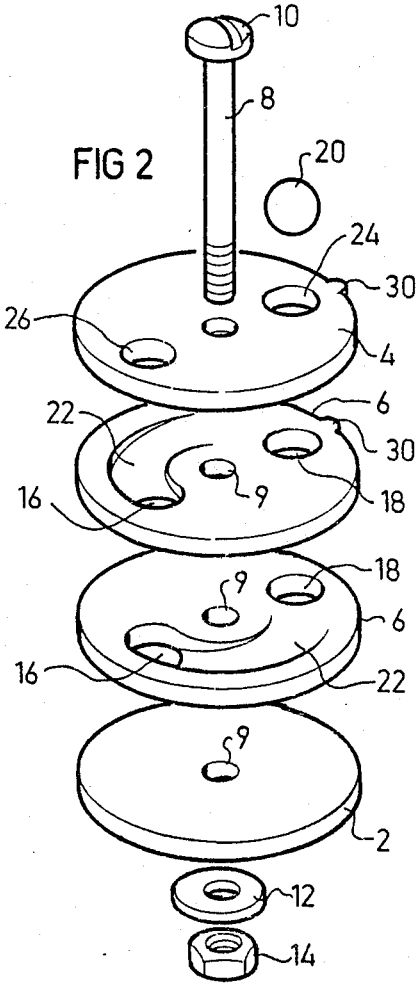
FIG 3
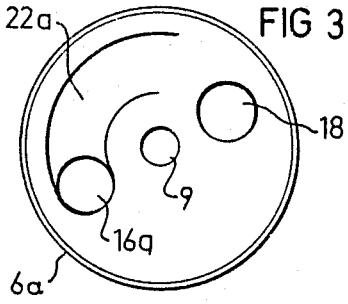
FIG 4
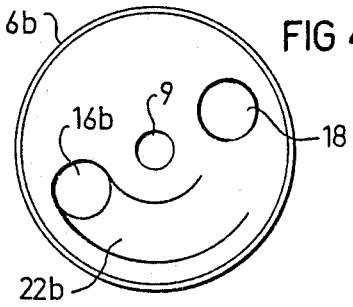
FIG 6
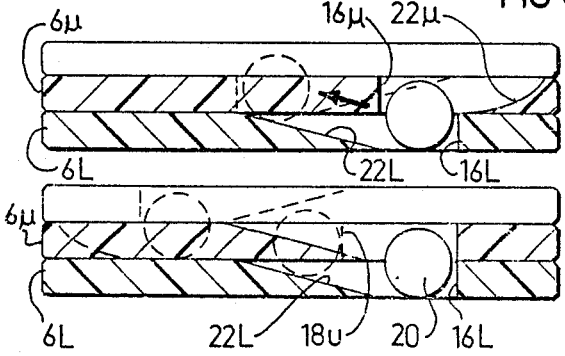
FIG 5
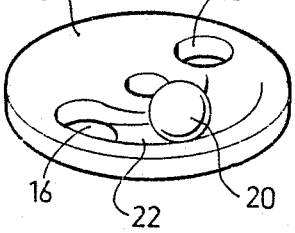
FIG 7

FIG 8
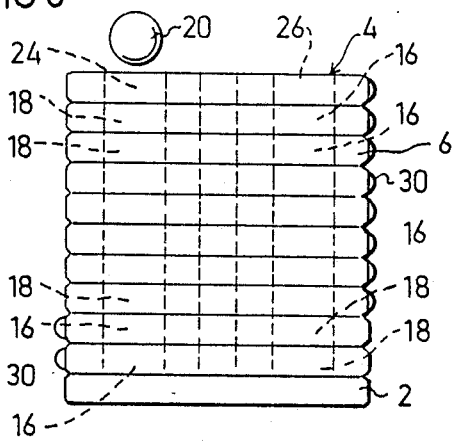
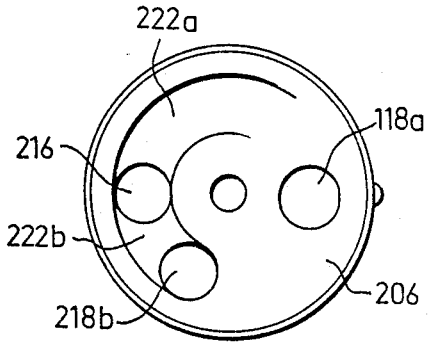
FIG 10
FIG. 9
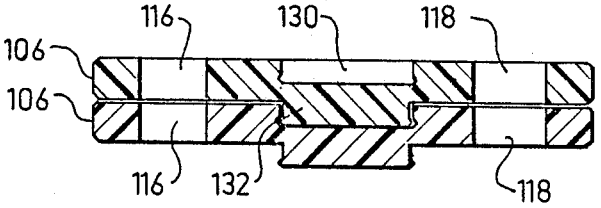
FIG 11
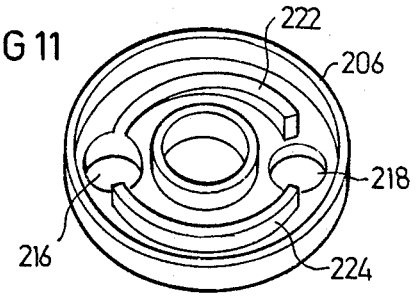
FIG 12
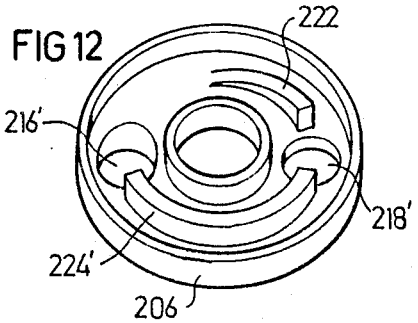
FIG 13
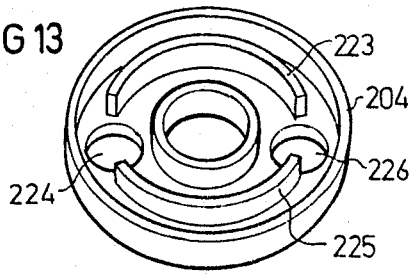

PUZZLE-TYPE AMUSEMENT DEVICE

BACKGROUND OF THE INVENTION

The present invention relates to amusement devices, and particularly to a puzzle-type amusement device.

Puzzle-type amusement devices require the user to manipulate a plurality of members in order to produce a solution to the puzzle. Probably, the most well known puzzle-type amusement devices are the "Magic Cube" requiring the 3-dimensional manipulation of the sides of a cube in order to arrange the elements thereon according to a predetermined order and the "Game 15", requiring the 2-dimensional manipulation of 15 elements, numbered "1–15", along two axes of a holder having 16 spaces to rearrange the elements in sequential order.

BRIEF SUMMARY OF THE INVENTION

An object of the present invention is to provide another puzzle-type amusement device including a plurality of elements to be manipulated by the user in order to produce a certain solution.

According to the present invention, there is provided an amusement device comprising a stack of discs including a bottom disc at one end, a top disc at the opposite end, and a plurality of intermediate discs, each rotatably mounted with respect to the others; each of the intermediate and top discs being formed with at least two openings adapted to be aligned with each other; and a ball of a diameter equal to or smaller than that of the openings so as to be receivable through one of the openings in the top disc and to pass through the openings aligned therewith in the intermediate discs to rest against the bottom disc; one of the openings in each intermediate disc being bounded at one side by a tapered surface curved about the axis of rotation of the disc so as to constitute an inclined track permitting the ball, when received in such opening, to be rolled along the inclined track out of the respective opening in the direction towards the top disc; the other of the openings in each intermediate disc being bounded on all its sides by an untapered surface such that the opening consitutes a trap preventing the ball, when received in the the opening, from being rolled out of the opening in the direction towards the top disc.

In using this amusement device, the user first aligns all the openings of the first-mentioned type (including the inclined tracks), drops the ball through the aligned openings to the bottom disc, and then manipulates the discs in order to advance the ball from one disc to the next in the direction towards the top disc in the shortest period of time.

According to a preferred feature in the embodiments of the invention described below, in some of the intermediate discs, the inclined track starts from one edge of the respective opening and is curved in one direction, while in others of the intermediate discs, the inclined track starts from the opposite edge of the respective opening and is curved in the opposite direction.

In one described embodiment all the discs are rotatably mounted to each other by a pin passing centrally through them; whereas in a second described embodiment, all the discs are rotatably mounted to each other by a circular recess formed in the face of one disc receiving a circular projection formed in the confronting face of the next adjacent disc. The discs, paricularly the intermediate discs, may be of solid construction whereby the tapered surface constituting the inclined track would be defined by tapering the thickness of the disc; or alternatively, they could be of hollow construction whereby the tapered surface constituting the inclined track would be defined by a curved rib having a tapered height.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a three-dimensional view illustrating one form of puzzle-type amusement device constructed in accordance with the present invention;

FIG. 2 is an exploded perspective view illustrating the construction of the device of FIG. 1;

FIGS. 3 and 4 are top plan views illustrating two of the intermediate discs used in the amusement device of FIGS. 1 and 2;

FIG. 5 is a perspective view illustrating the manner in which a ball may be unseated from an opening in one disc and advanced through an opening in the next adjacent disc in the direction towards the top disc;

FIG. 6 illustrates a desired manipulation which will permit the ball to be advanced through another disc in the subsequent manipulations;

FIG. 7 illustrates an undesired manipulation which will cause the ball to be trapped and prevent its advancement in the next manipulation;

FIG. 8 is a side plan view illustrating the stack with registration projections to aid in initially aligning the discs;

FIG. 9 is an enlarged sectional view through two intermediate discs in a stack rotatably mounted in another manner;

FIG. 10 illustrates a further modification that may be made in the construction of the amusement device; and FIGS. 11 and 12 illustrate two hollow disc constructions that may be used for the intermediate discs;

and FIG. 13 illustrates a hollow top disc that may be used.

DESCRIPTION OF PREFERRED EMBODIMENTS

The amusement device illustrated in FIGS. 1 and 2 comprises a stack of discs, including a bottom disc 2 at one end, a top disc 4 at the opposite end, and a plurality of intermediate discs 6, all of the discs being of the same circular configuration. The discs are all rotatably mounted with respect to each other by a pin 8 passing through central openings 9 formed in all the discs. An enlarged head 10 at one end of pin 8 engages the outer face of the top disc 6; a washer 12, secured to the opposite end of pin 8 by a nut 14, engages the outer face of the bottom disc 2.

Each of the intermediate discs 6 is formed with two further openings 16, 18, besides the central opening 9 form receiving the central pin 8. Both openings 16 and 18 are of the same diameter and are adapted to receive a ball 20, also of the same or slightly larger diameter, such that the ball may be passed through these openings, when aligned with each other, to rest against the bottom disc 12 which is not formed with such openings. As shown particularly in FIGS. 6 and 7, ball 20 has a diameter equal to approximately twice the thickness of the intermediate disc 6, and also of the top disc 4.

Opening 16 formed through each of the intermediate discs 6 is bounded at one side by a tapered surface 22 starting from the edge of the opening and curved about the axis of rotation of the disc so as to constitute an inclined track which permits the ball 20, when received in that opening, to be rolled along the inclined track out of the respective opening in the direction towards the top disc 4. This can be more clearly seen in FIG. 5 illustrating the ball 20, originally in opening 16, rolling along the curved track 22 out of the opening.

Opening 18, however, formed in each of the inermediate discs 6, is bounded on all its sides by an untapered surface; that is, the portion of the disc through which opening 18 is formed is of uniform thickness and includes flat planar surfaces on its opposite faces. As will be described more particularly below, openings 18 formed in the intermediate discs 6 constitute traps preventing the ball, when received in such opening, from being rolled out of the opening in the direction towards the top disc 4.

In some of the intermediate discs 6, illustrated by disc **6*a* in FIG. 3, the inclined track 22*a* starts from one edge of the respective opening 16*a* and is curved in one direction (clockwise), whereas in others of the intermediate discs, illustrated by intermediate disc 6*a* in FIG. 4, the inclined track 22*b* starts from the opposite edge of the respective opening 16*b* and is curved in the opposite direction. Preferably, the discs of the type illustrated at 6*a* in FIG. 3 alternate with the discs of the type illustrated at 6*b* in FIG. 4. While FIG. 2 illustrates only two intermediate discs, it will be appreciated that the stack would include any desired number. FIG. 1 illustrates the stack as including eight intermediate discs 6, in addition to a bottom disc 2 and a top disc 4**.

As mentioned earlier, the bottom disc 2 does not include any openings comparable to openings 16 and 18 in the intermediate discs 6. The top disc 4, however, includes two openings 24, 26, both of the type illustrated by openings 18 in the intermediate discs 6, namely openings not bounded by curved inclined tracks corresponding to tracks 22 of openings 16.

FIG. 8 illustrates a stack in which the intermediate discs 6 and top disc 4 include reference projections 30 along the edge adjacent to the openings 16 formed with the inclined tracks 22. These projections thus enable identification of the location of these openings.

The puzzle-type device illustrated in FIGS. 1–8 of the drawings may be used in the following manner:

First, all the intermediate discs 6 are rotated so as to bring openings 16 of the intermediate discs 6 into alignment with each other and with opening 24 in the top disc 4, and to bring openings 18 in the intermediate discs into alignment with each other and with opening 26 in the top disc, except for the two botom discs 6, wherein their openings 16 are aligned with openings 18 in the remaining discs. This is apparent by the portions of the reference projections 30 indicating the locations of openings 16 formed with the inclined tracks 22.

The ball 20 is then passed through opening 26 in the top disc 4, whereupon it falls by gravity through the aligned openings 18 in the intermediate discs 6 and rests against the bottom disc 2 within openings 16 in the two lowermost imtermediate discs 6.

The user then rotates the intermediate discs 6, one-by-one, starting from the lowermost ones, in an attempt to advance the ball 20 through the openings 16 of the intermediate discs in the direction towards the top disc 4, and then out through opening 24 in the top disc.

During these manipulations of the intermediate discs 6, the user has to exercise care not to move the ball into one of the untracked openings 18 formed in the intermediate discs 6, as this would trap the ball and prevent its movement out of that opening in the direction towards the top disc 4.

FIG. 6, for example, illustrates a desired movement of an upper disc **6*u* with respect to a lower disc 6L when the ball 20 is in opening 16 of the lower disc. Thus, the upper disc 16*u* should be moved so that its opening 16*u* is aligned with opening 16L of the lower disc, and in the direction such that track 22*u* is on the opposite side of the direction of movement of the upper disc 6*u* with respect to the lower disc. The ball 20 then rides on tract 22L of the lower disc 6L and is received within opening 16*u* of the upper disc 6. In this position, the ball can be moved out of opening 16*u* of disc 6*u* via its track 22*u* by rotating the next disc, thereby advancing the ball in the direction of the upper disc 4**.

FIG. 7 illustrates an undesired movement of the upper disc **6*u* with respect to the lower disc 6L which traps the ball and prevents it from being advanced towards the top disc 4 in the next operation. Thus, in FIG. 7 the ball 20 is seated in opening 16L of the lower disc 6L, as in FIG. 6, but instead of manipulating the upper disc 6*u* so as to bring its opening 16*u* formed with the inclined track 22*u* into alignment with the ball, the upper disc 6*u* is rotated so as to bring its opening 18 into alignment with the ball. The rotation of the upper disc 6*u* will unseat ball 20 from the lower disc opening 16L, but then the ball will be received within the upper disc opening 18*u*, which is not provided with a curved track, and therefore the rotation of the next disc will not advance the ball 20 in the direction of the top disc 4. If the ball is received in one of the trap openings 18**, the only way of exiting therefrom is in the downward direction, provided there are at least two intermediate discs below the one trapping the ball.

FIG. 9 ilustrates another manner of rotatably mounting the intermediate discs 106 and top disc 104 with respect to the bottom disc 102. In the arrangement illustrated in FIG. 9, each of the intermediate discs 106 is formed on one face with a central circular recess 130, and with a central circular projection 132 on the opposite face, such that the projection 132 of one disc 106 may be rotatably mounted in the recess 130 of the next adjacent disc.

FIG. 10 illustrates a further modification wherein the intermediate discs, therein designated 206, include an opening 216, corresponding to opening 16 in FIGS. 1–8, and two (or more) trap openings **218*a*, 218*b*, corresponding to openings 18 in FIGS. 1–8. Each opening 216 is formed with an inclined curved track 222*a*, 222*b*, corresponding to track 22 in FIGS. 1–8, on each of its two opposite sides, one of which tracks is occupied by one of the trap openings, 218*b***.

While the invention has been described with respect to several preferred embodiments, it will be appreciated that many other variations and modifications may be made. For example, each disc may be of a hollow construction, rather than of a solid construction as illustrated in FIGS. 1–10.

Such a hollow construction for the intermediate discs 206 is illustrated in FIGS. 11 and 12, wherein it will be seen that the tapered surface constituting the inclined track, instead of being defined by the tapering thickness of the disc as in the earlier-described embodiments, is defined by a curved rib 222 having a tapered height. In FIG. 11, the curved rib 222 extends between openings 216 and 218 on one side of the disc, a second curved rib 224 of the same height being provided between these two openings on the opposite side of the disc.

FIG. 12 illustrates an intermediate disc 206' of hollow construction similar to that of FIG. 11, but in this case the tapered rib 222' starts, not at the edge of opening 216' as in FIG. 11, but rather at an intermediate position between openings 216' and 218'. The second curved rib 224' on the opposite side of the disc is of constant height, as in FIG. 11.

FIG. 13 illustrates a hollow top disc 204 for use with either of the FIG. 11 or FIG. 12 constructions for the intermediate discs. In FIG. 13, the top disc is formed with two curved ribs 223, 225 of the same height on opposite sides of the openings 224, 226. In use, top disc 204 is inverted over the uppermost intermediate disc 206 and its ribs 223, 225 cause the ball to roll it along the inclined track, defined by the tapered rib 222 or 222' until it emerges from hole 226 in the top disc.

It will be appreciated that the discs could have a different arrangement or number of openings; also, the bottom disc could be formed integrally with the lowermost intermediate disc, i.e., closed at its bottom face but formed with the holes and tracks on its upper face. Many other variations, modifications and applications of the invention will be apparent.

What is claimed is:

1. A puzzle-type amusement device comprising: a stack of discs including a bottom disc at one end, a top disc at the opposite end, and a plurality of intermediate discs, each rotatably mounted with respect to the others; each of said intermediate and top discs being formed with at least two openings adapted to be aligned with each other; and a ball of a diameter equal to or smaller than that of said openings so as to be receivable through one of the openings in the top disc and to pass through the openings aligned therewith in the intermediate discs to rest against the bottom disc; one of said openings in each intermediate disc being bounded at one side by a tapered surface curved about the axis of rotation of said intermediate disc so as to constitute an inclined track permitting the ball, when received in such opening, to be rolled along said inclined track out of the respective opening in the direction towards said top disc; the other of said openings in each intermediate disc being bounded on all its sides by an untapered surface such that said other opening constitutes a trap preventing the ball, when received in the said other opening, from being rolled out of said other opening in the direction towards said top disc.

2. The amusement device according to claim 1, wherein, in some of said intermediate discs, said inclined track starts from one edge of the respective opening and is curved in one direction, while in others of said intermediate discs, said inclined track starts from the opposite edge of the respective opening and is curved in the opposite direction.

3. The amusement device according to claim 1, wherein said ball diameter is approximately twice the thickness of the intermediate and top discs.

4. The amusement device according to claim 1, wherein both of said openings in the top disc are bounded by an untapered surface on all its sides.

5. The amusement device according to claim 1, wherein each of said intermediate discs includes only one of said openings formed with the curved inclined track, and only one of said trap openings.

6. The amusement device according to claim 1, wherein each of said intermediate discs includes one opening formed with a curved inclined track, starting from each of its two opposite edges, and two of said trap openings, one of which is located in one of the curved inclined tracks.

7. The amusement device according to claim 1, wherein all said discs are rotatably mounted to each other by a pin passing centrally therethrough.

8. The amusement device according to claim 1, wherein all said discs are rotatably mounted to each other by a circular recess formed in the face of one disc receiving a circular projection formed in the confronting face of the next adjacent disc.

9. The amusement device according to claim 8, wherein said circular recesses and circular projections are formed centrally of the discs.

10. The amusement device according to claim 1, wherein the outer edges of said intermediate discs are formed with alignment projections for facilitating the alignment of their openings.

11. The amusement device according to claim 1, wherein said intermediate discs are of solid construction, whereby said tapered surface constituting the inclined track is defined by tapering the thickness of the disc.

12. The amusement device according to claim 1, wherein said intermediate discs are of hollow construction, said tapered surface constituting said inclined track being defined by a curved rib having a tapered height.

13. A puzzle-type amusement device comprising: a stack of discs including a bottom disc at one end, a top disc at the opposite end, and a plurality of intermediate discs, each rotatably mounted with respect to the others; each of said intermediate and top discs being formed with at least two openings adapted to be aligned with each other; and a ball of a diameter equal to or smaller than that of said openings so as to be receivable through one of the openings in the top disc and to pass through the openings aligned therewith in the intermediate discs to rest against the bottom disc; one of said openings in each intermediate disc being bounded at one side by a tapered surface curved about the axis of rotation of said disc so as to constitute an inclined track permitting the ball, when received in said opening, to be rolled along said inclined track out of the respective opening in the direction towards said top disc; the other of said openings in each intermediate disc being bounded on all its sides by an untapered surface such that said other opening constitutes a trap preventing, when received in said other opening, from being rolled out of said other opening in the direction towards said top disc; said inclined track starting from one edge of the respective opening and being curved in one direction in some of said intermediate discs, while in others of said intermediate discs, said inclined track starts from the opposite edge of the respective opening and is curved in the opposite direction.

14. The amusement device according to claim 13, wherein each of said intermediate discs includes only one of said openings formed with the curved inclined track, and only one of said trap openings.

15. The amusement device according to claim 13, wherein each of said intermediate discs includes one opening formed with a curved inclined track, starting from each of its two opposite edges, and two of said trap openings, one of which is located in one of the curved inclined tracks.

16. The amusement device according to claim 13, wherein all said discs are rotatably mounted to each other by a pin passing centrally therethrough.

17. The amusement device according to claim 13, wherein all said discs are rotatably mounted to each other by a circular recess formed in the face of one disc receiving a circular projection formed in the confronting face of the next adjacent disc.

18. The amusement device according to claim 17, wherein said circular recesses and circular projections are formed centrally of the discs, and wherein the outer edges of said intermediate discs are formed with alignment projections for facilitating the alignment of their openings.

19. The amusement device according to claim 13, wherein said intermediate discs are of solid construction, whereby said tapered surface constituting the inclined track is defined by tapering the thickness of the disc.

20. The amusement device according to claim 13, wherein said intermediate discs are of hollow construction, said tapered surface constituting said inclined track being defined by a curved rib having a tapered height.

* * * * *